United States Patent [19]

Nikolov

[11] Patent Number: 4,550,763

[45] Date of Patent: Nov. 5, 1985

[54] METHOD AND MACHINE FOR PRESSURE DIECASTING

[75] Inventor: Ivan D. Nikolov, Sofia, Bulgaria

[73] Assignee: Institute po Metaloznanie I Technologia na Metalite, Sofia, Bulgaria

[21] Appl. No.: 326,479

[22] Filed: Dec. 2, 1981

[30] Foreign Application Priority Data

Dec. 11, 1980 [BG] Bulgaria ..... 49948

[51] Int. Cl.[4] ..... B22D 17/06

[52] U.S. Cl. ..... 164/119; 164/719

[58] Field of Search ..... 164/119, 120, 66.1, 164/259, 305, 306, 309, 61, 65, 253, 256, 257, 258

[56] References Cited

U.S. PATENT DOCUMENTS

| | | | |
|---|---|---|---|
| 2,847,739 | 8/1958 | Sylvester | 164/119 |
| 3,635,791 | 1/1972 | Bly et al. | 164/119 |
| 3,650,313 | 3/1972 | Balevski et al. | 164/66.1 |
| 3,693,698 | 9/1972 | Balevski et al. | 164/258 |
| 3,761,218 | 9/1973 | Portalier | 164/119 |
| 3,862,656 | 1/1975 | Weiler et al. | 164/119 |

FOREIGN PATENT DOCUMENTS

| | | | |
|---|---|---|---|
| 18798 | 1/1961 | Bulgaria . | |
| 16793 | 9/1971 | Bulgaria . | |
| 0644194 | 7/1962 | Canada | 164/306 |
| 2437734 | 2/1976 | Fed. Rep. of Germany . | |
| 2947602 | 7/1979 | Fed. Rep. of Germany . | |
| 1525455 | 5/1968 | France | 164/119 |
| 2147827 | 3/1973 | France . | |
| 2270037 | 5/1974 | France . | |
| 2378591 | 9/1978 | France | 164/309 |
| 0461798 | 8/1975 | U.S.S.R. | 164/309 |
| 0616061 | 7/1978 | U.S.S.R. | 164/309 |

*Primary Examiner*—Nicholas P. Godici
*Assistant Examiner*—Richard K. Seidel
*Attorney, Agent, or Firm*—Karl F. Ross; Herbert Dubno

[57] ABSTRACT

A pressure die casting method and apparatus wherein the delivery tube from the melt reservoir contained in the pressurizable housing can receive the melt on the tube affixed to the mold which also is in a pressurizable housing and when the latter tube is retracted from the former, a sliding shutter closes the top of the reservoir tube. Gas communication between the upper end of the reservoir tube and the interior of the housing is permitted to ensure that a gas layer corresponding to that in the housing will overlie the melt in the reservoir portion of the tube.

7 Claims, 4 Drawing Figures

METHOD AND MACHINE FOR PRESSURE DIECASTING

FIELD OF THE INVENTION

This invention relates to a method and machine for pressure diecasting, which can be used in the foundry production of castings of different materials.

BACKGROUND OF THE INVENTION

In a known pressure diecasting method Bulgarian Pat. No. 187/98, particularly for casting under counter-pressure under the action of the pressure differential between the sealed chamber with the melt reservoir and the sealed chamber with the mold, the melt passes through a conduit and fills the casting mold, while during mold filling a gas counter-pressure is acting inside the sealed chamber containing the mold.

A drawback of this method is that, when the casting mold is opened, the feed conduit is connected directly to the ambient atmosphere and the melt within it is under the action of the gas contained inside the mold, or under the action of air. As a result, the castings have a number of defects which are due to the following causes: the interaction of the gas or air and the cast material; the dissolution in the melt or non-release from it of additional quantities of gas; and variations in the gas content of the produced castings.

Another drawback is that a large quantity of gas is used for effecting the operation of casting. This is not favourable from an energy viewpoint and causes, moreover, a varying quality of the subsequently produced castings. This is a result of the disturbed equilibrium between the dissolved gases and other volatile components of the melt and the partial pressures of these components in the gaseous phase over the melt.

A known low-pressure diecasting machine (French Pat. No. 2,147,827) comprises a sealed chamber inside which there is placed a crucible with molten metal. This sealed chamber is connected to a pressure chamber. The casting mold is placed over the pressure chamber. The sealed chamber and the pressure chamber are connected by a metal conduit, one end of which is immersed in the crucible with molten metal. Two conical cavities are shaped in the pressure chamber, which are interconnected and connected to the metal conduit. One conical cavity is connected in its upper end to the casting mold, while the other cavity is connected to a pipe conduit with a valve which has at least four ports. The first port of the valve is connected to a source of pressurized gas, the second—to the gas space of the sealed chamber, the third—to the pipe conduit of the second conical cavity of the pressure chamber, and the fourth—to the atmosphere.

Both conical cavities of the pressure chamber are of practically equal volume and are connected by a hole with a cross-sectional area equal to that of the metal conduit. The volume of the conical cavity which is connected to the valve is such, that when the casting mold is full, the level of the melt within this cavity remains below a preset level.

The pressure chamber is provided in its upper part, i.e. over the commencement of the pipe conduit connecting the one conical cavity to the valve, with a device which stops the gas delivery in this cavity when the melt inside it reaches the preset level.

A drawback of this machine lies in that it allows the casting of parts only under low pressure and is specially adapted to the casting of thin-walled hollow parts; this requires an additional intermediate pressure chamber with a valve for the control of the steps of the casting process.

Another drawback is that the seals between the surfaces of the different components of the machine are not protected from possible contact with the melt; this makes necessary the use of plastically deformable components which must be frequently replaced as a result of quick wear.

Another drawback of this machine is that its productivity is low because the mold is removed after the solidification of the melt and this requires considerably more time than the duration of mold filling.

Another machine (Bulgarian Pat. No. 16,793) for casting metals under gas counter-pressure comprises a sealed melt reservoir, closed by an intermediate plate which carries the feed tube and the casting die. The material feed tube is sealed to the intermediate cover by means of a plastically deformable seal, and the die is sealed to the flange of the material feed tube against leakage of melt by means of mating surfaces and a thin plastic gasket.

A drawback of this machine is its low productivity because of the several times longer time for solidification of the melt and for cooling the cast body down to the temperature of removal, as compared to the time necessary for filling the casting die. This drawback is particularly noticeable when using built-up dies in which the complex inner and outer surfaces of the casting are shaped by cores arranged in a metal box. This is also valid for the casting in combined sand-metal molds and in sand molds.

A substantial drawback of this machine is that very complex devices are required for maintaining the filling of the die at one and the same pressure at a gradual drop of the level of the melt inside the sealed reservoir. Therefore, the production of subsequent castings of constant quality is not ensured.

Another drawback is that the plastically deformable seal is not adapted for sealing against flow-out of melt during the change of the casting dies. It is not possible to ensure a sealing of the die against the flange of the material feed conduit only by pressing mating surfaces.

OBJECT OF THE INVENTION

It is therefore a general object of this invention to provide a method of and a machine for pressure diecasting with greater technological possibilities when casting different materials, as well as in operation with different casting molds, which can ensure the filling at the same pressure of subsequently used casting dies, the result of this being the production of castings of uniform quality.

SUMMARY OF THE INVENTION

This object is achieved by a method in which the melt, under the action of pressure or of a difference between the pressures in the sealed chamber with the melt reservoir and the chamber with the casting die, passes from the sealed chamber with the melt reservoir through a material feed conduit and fills the casting die. The melt solidifies in the die and, immediately after solidification or immediately after the die is filled with melt, a gas pressure is produced above the melt in the material feed conduit. This gas pressure is produced by the same gaseous phase as in the pressurized chamber with the melt reservoir, and before starting the nextsubsequent cycle the space of the casting die is purged by blowing-through this same gaseous phase.

The object of this invention is also achieved by a machine which comprises a sealed chamber with a cover, inside which there is mounted a reservoir for the melt. This sealed chamber is connected by means of a material feed conduit to the casting die. This conduit is made of two separate feed tubes: a basic tube and an supplementary tube. The basic feed tube is provided with an enlargement in which there is mounted the supplementary feed tube. The basic feed tube is closed by a flange cover, by means of which it is connected to an intermediate platen, above which the die is mounted.

To the cover of the sealed chamber there is provided a neck, to which a cylinder, enclosed by a hood, is mounted. The basic feed tube is fastened to this cylinder. The hood is attached to the intermediate platen and is provided with a bed for a slide valve, which is connected to a horizontal hydraulic cylinder.

The space of the basic feed tube is connected to the space of the sealed chamber by means of a first pipe conduit through a first valve.

The hood is connected to the outer surface of the cylinder by means of a sliding seal.

The space between the hood and the cylinder is connected to the space of the sealed chamber by means of a second pipe conduit through a second valve, provided with a pressure gauge.

When casting under counter-pressure, the die is closed by a tight cover, attached to the intermediate platen and connected to a vertical hydraulic cylinder.

In this case, the space of the basic feed tube, the space of the sealed chamber and the space of the sealed cover are connected inbetween by means of a third and fourth valves through a third pipe conduit, and a pressure differential gauge is provided. The space of the sealed cover is connected by means of a fifth pipe conduit and a fifth valve to the space between the hood and the cylinder.

In another embodiment of the machine of the invention, a lever mechanism is attached to the basic feed tube, this mechanism being connected to a third vertical hydraulic cylinder. A recess is shaped in the bottom of the sealed chamber with the melt reservoir.

The method and machine of this invention are featured by the following advantages:

a total protection of the melt within the material feed conduit from the influence of air or of the gas inside the casting die is provided, thus ensuring the production of castings of high quality a possibility is provided for blowing-through the die before the next-following casting operation with a gas, which is the same as that in the melt reservoir;

the consumption of gas for producing and maintaining a pressure in the melt reservoir is reduced, since it is reduced only to the loss of the gas pushed out by the melt during the filling of the die and, eventually, for blowing-through the die;

the partial pressures of the gases comprising the gaseous phase inside the melt reservoir and the basic feed tube are equal and practically do not vary in the subsequent production of castings; this makes it possible to achieve a maximum quantity of dissolved gases and other components in the melt, particularly when these components have a high vapor or dissociation pressure at the temperature of casting;

it is possible, for a short time before the filling of the die, to increase or reduce the partial pressure of a given active alloying gas simultaneously in the melt reservoir, in the basic feed tube and in the die. This influences the structure formation and ensures the retaining in the form of solid solution of the alloying gas in the cast body in conformity with the abrupt change of its solubility in the phase transition solid-to-liquid state, and this is practically the same for all subsequent casting of one melt charge in the melt reservoir;

the possibility of variation of the level of the melt in the material feed conduit is avoided, thus ensuring a full control of the filling of the die with the melt.

BRIEF DESCRIPTION OF THE DRAWING

For a better understanding of the invention, reference should be made to the accompanying drawing in which there are illustrated and described preferred embodiments of the machine of the invention. In the drawing.

SPECIFIC DESCRIPTION

Figure 1:
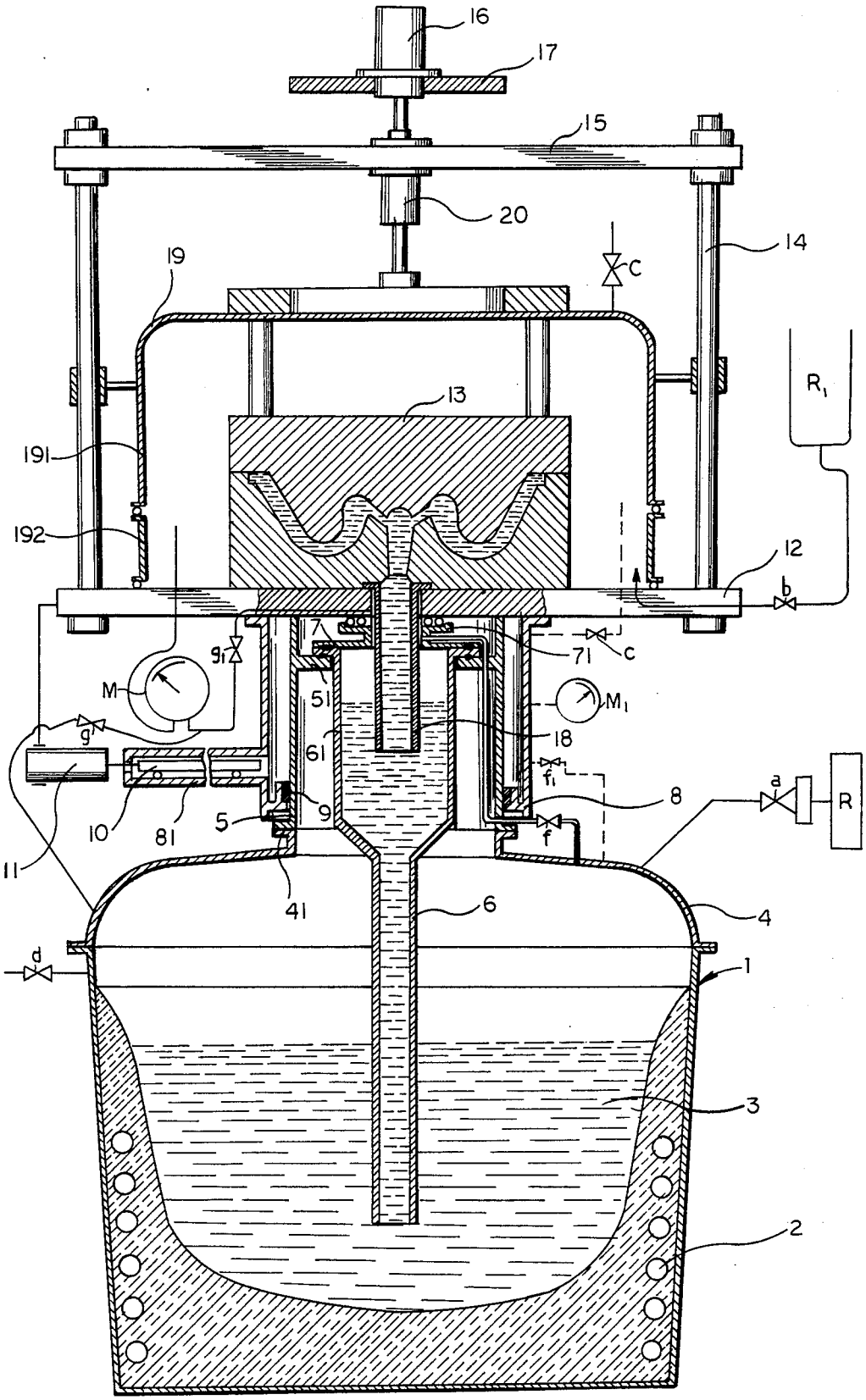
FIG. 1 is a diagrammatical cross-sectional view of a machine when casting under counter-pressure.
Figure 2:
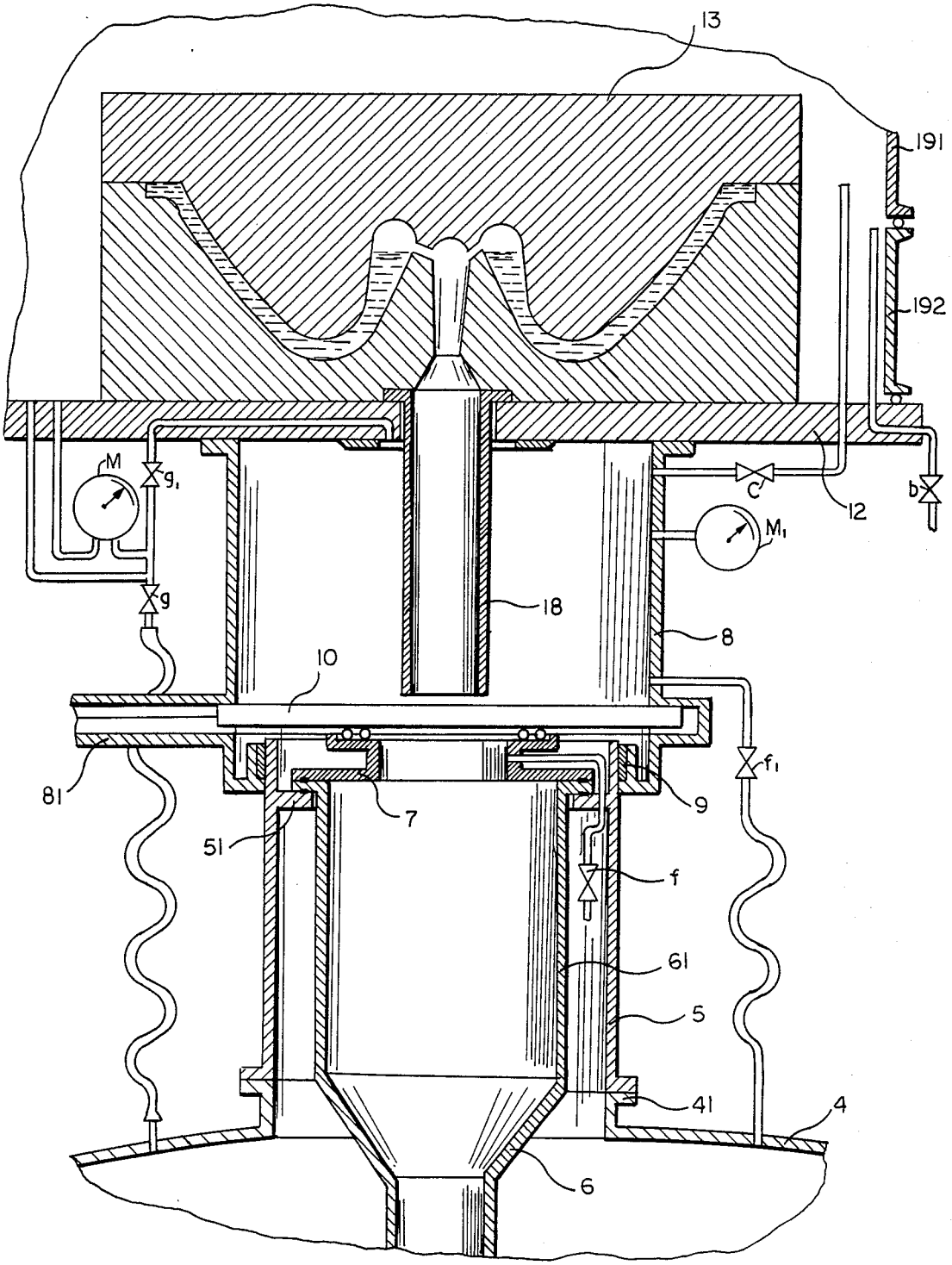
FIG. 2 is a longitudinal cross-sectional view of the material feed conduit and the casting die, before connecting the basic feed tube to the casting die.
Figure 3:
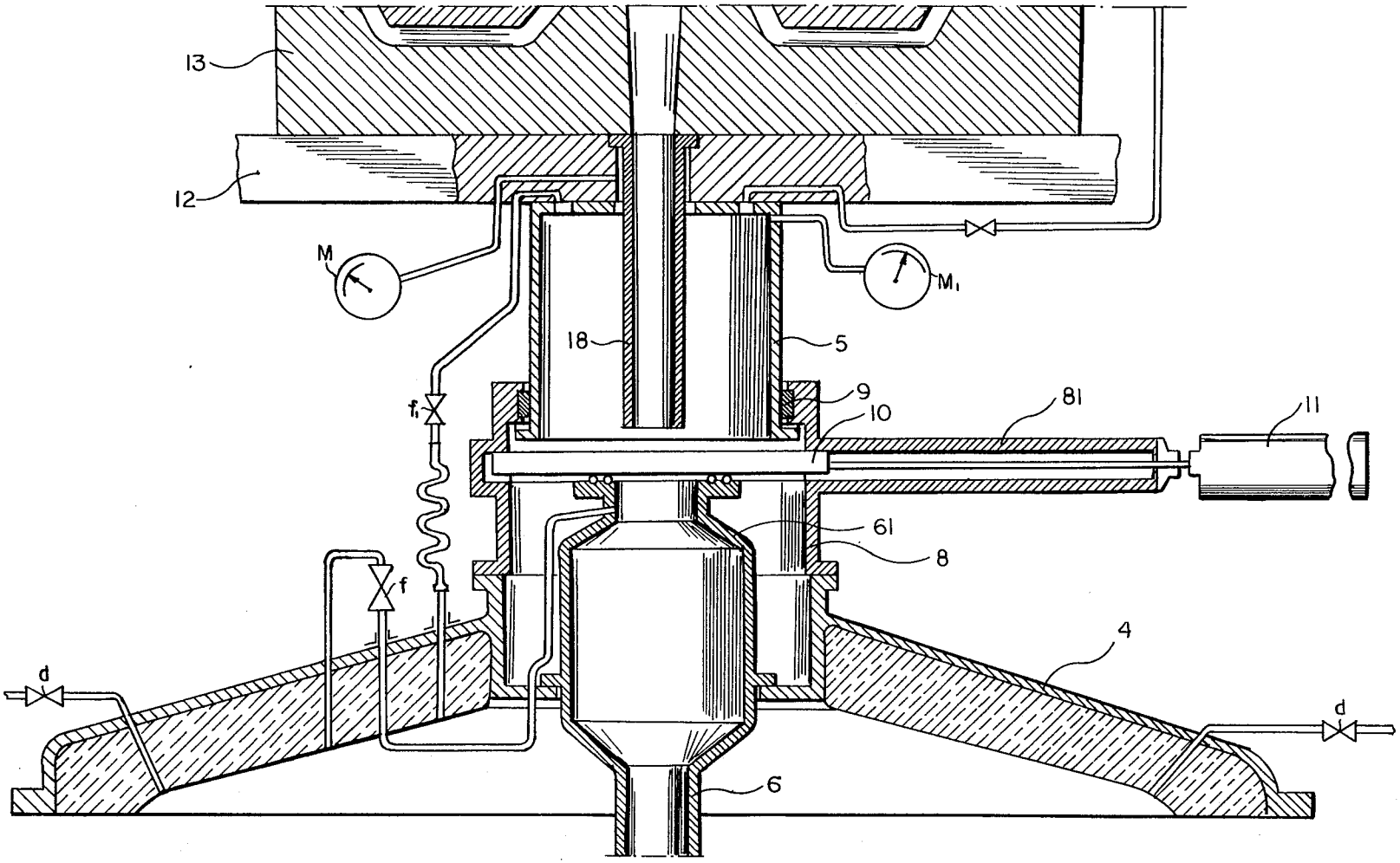
FIG. 3 shows diagrammatically how the method is effected in another embodiment of the machine—when the sealed chamber together with the basic feed tube are movable.

The machine, according to FIGS. 1, 2 and 3, comprises a sealed chamber 1 inside which a reservoir 2 for the melt 3 is mounted. The sealed chamber 1 is closed by a cover 4, on which a neck 41 is provided. A cylinder 5 is mounted to the neck 41, the upper end of the cylinder being shaped as an internal flange 51. The sealed chamber 1 is connected by means of a material feed conduit to the casting die 13. The material feed conduit is made of two separate feed tubes—a basic tube 6 and an additional tube 18. The basic feed tube 6 is provided with an enlargement 61 in which the additional feed tube 18 is disposed. The basic feed tube 6 is closed by a flange cover 7 by means of which it can bear against the intermediate platen 12. The flange cover 7 is provided with a hole 71. Valve a connects the chamber 1 to the pressure reservoir R and valve b connects the mold chamber to the reservoir R1.

On the lower surface of the intermediate platen 12 there is mounted a hood 8 inside which is the cylinder 5. The hood 8 is connected to the outer surface of cylinder 5 by the sliding seal 9. The hood 8 is provided with a valve bed 81 for the slide valve 10, which is connected to a horizontal hydraulic cylinder 11.

The casting die 13 fastened to the intermediate platen 12 communicates with the additional feed tube 18. The die 13 is closed by a sealed cover 19 which is mounted to the intermediate platen 12 and is connected to a first vertical hydraulic cylinder 20. The sealed cover 19 comprises two parts—an upper part 191 and a bottom cylindrical part 192.

The intermediate platen 12 is fastened by means of carrying columns 14 to the cross-piece 15, which is connected to the piston of a second hydraulic vertical cylinder 16. To the cross-piece 15 there is fastened the first vertical hydraulic cylinder 20, while the second vertical hydraulic cylinder 16 is fastened to a support 17.

The space of the basic feed tube 6 is connected by means of a first pipe conduit f with the space of the sealed chamber 1.

The space between cylinder 5 and hood 8 is connected to the space of the sealed chamber 1 by means of a second pipe conduit $f_1$, where a pressure gauge $M_1$ is provided. The space of the sealed cover 19 and the space of the sealed chamber 1 are connected by means of a third pipe conduit through a third valve $g_1$ and a fourth valve g, and there is provided a differential pressure gauge M. The space of the sealed cover 19 is connected by means of a fifth pipe conduit and a fifth valve c to the space between the hood 8 and the cylinder 5.

Figure 4:
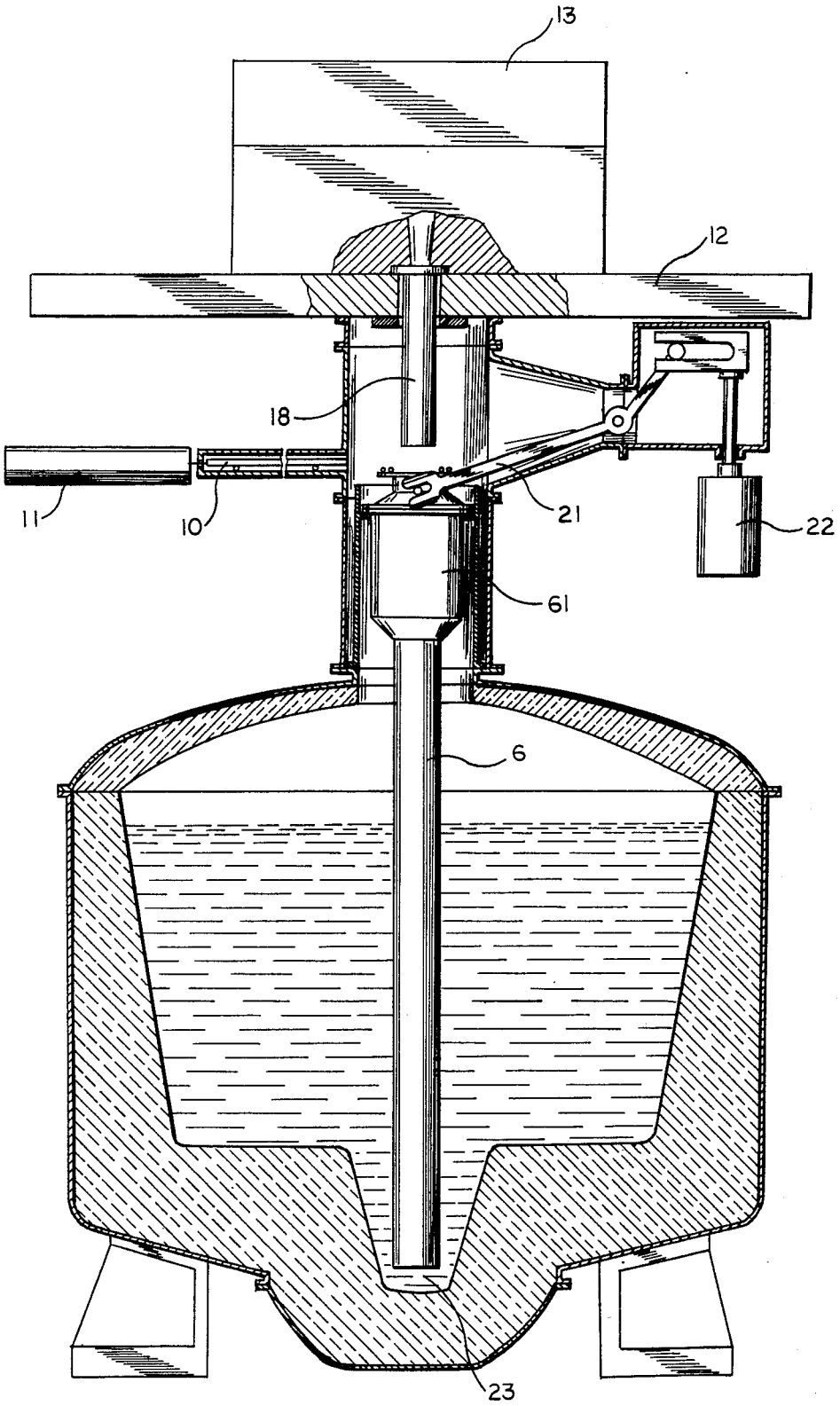
FIG. 4 is a diagrammatic cross-sectional view of another embodiment of the machine, in which the basic feed tube is movable.

According to the embodiment shown in FIG. 4, to the basic feed tube 6 there is mounted a lever mechanism 21 intended for its displacement in vertical direction and connected to a third vertical hydraulic cylinder 22. In the bottom of reservoir 2 for the melt 3 there is shaped a recess 23.

The following example illustrates the operation of the method and the machine, according to the invention, in the casting of strongly reactive to the atmosphere materials, such as magnesium alloys, when casting under counter-pressure in a die and using two gases: a protective gas in the sealed chamber with the melt reservoir—sulfur dioxide or argon—and a gas for producing the counter-pressure inside the mould—nitrogen.

In the initial position, the upper part of the casting die 13 is removed and the sealed cover 19 is open, while the flange cover 7 of the basic feed tube 6 is closed by the slide valve 10 which is in the position also seen in FIG. 2. The space within the sealed chamber 1 with the reservoir 2 with melt 3 is filled with sulphur dioxide or argon, or with a mixture of both gases at a preset pressure. The valve f is open and the pressure of the gas in the space of the sealed chamber 1 and the space in the basic feed tube 6 above the melt 3 is equalized, and its magnitude is read on the differential pressure gauge M, when the valve g is open and valve $g_1$ is closed. Valves a, b, c, d, $f_1$ are closed.

The working cycle of casting is effected as follows:

The sealed cover 19 is closed together with the upper part of the die 13 by downward motion, caused by the first vertical hydraulic cylinder 20, thus sealing tightly the closed space. Valves b and $c_1$ are opened and the space closed by the sealed cover 19 is filled with nitrogen until the pressure reaches that in the sealed chamber 1; this is indicated by zero reading on the differential pressure gauge M, and then valve b is closed. A signal is given for moving the intermediate platen 12 downward from its upper end position; then the slide valve 10 is opened, while the second vertical hydraulic cylinder 16 moves the intermediate platen 12 downwards until it reaches the elastic seal, provided on the flange cover 7 of the basic feed tube 6. In this moment the additional feed tube 18 enters in the enlargement 61 of the basic feed tube 6. A signal is given for closing valves c and g and opening valve a, which controls the desired operation of casting, as well as valves $f_1$ and $g_1$.

The pressure within the sealed chamber 1 begins to rise. The melt 3 begins to rise in the basic feed tube 6 pushing in front of it the sulfur dioxide or argon. During this time the differential pressure gauge M indicates a low superpressure, resulting from the throttling action of the venting channels of the casting die 13. When the melt 3 reaches the bottom end of the additional feed tube 18, it continues to rise in it pushing out of the die 13 the lighter nitrogen and replacing it by the sulfur dioxide or argon moving in front of it, while the melt in the space between both feed tubes compresses the entrapped sulfur dioxide or argon.

The die 13 is filled with melt, which is practically all the time in contact with a protective gas, such as sulfur dioxide or argon. Until the filling up of the die 13 with melt, the differential pressure gauge M indicates an increase of the pressure as a function of time according to a law specific to the configuration of the cavity of the die 13. After the die 13 is filled up, the pointer of the differential pressure gauge M begins to deviate quickly and at a known preset magnitude of the read difference between the pressures, a signal for closing valve a is given.

In the case of top pouring, simultaneously with the closing of valve a, valve f is opened and there is achieved a quick equalization of the pressure in the space of the basic feed tube 6 and the space of reservoir 2. The melt level in the space between the basic feed tube 6 and the additional feed tube 18 drops, while after opening the additional feed tube 18 the protective gas (sulfur dioxide or argon), of the same composition as that in the reservoir 2 with melt 3, enters the additional feed tube and the die 13 and pushes out of there the melt which is below the level of the feeders. After this stage it is possible to actuate the horizontal hydraulic cylinder 11 for moving the slide valve 10 inwards, and at that the additional feed tube 18 comes out of the enlargement 61 of the basic feed tube 6. At end position of the slide valve 10, a signal is given for its movement until it comes above the flange cover 7. With a small motion downwards of the intermediate platen 12, by means of the second vertical hydraulic cylinder 16, the slide valve 10 presses the elastic seal over the flange cover 7. The safety valve $f_1$ is closed, which during the operation of casting has been opened after the closing of valve f to avoid a possible contact of the melt 3 during its rise with the elastic seal, in the event of poor sealing between the enlargement 61 of the basic feed tube 6 and the intermediate platen 12. During the filling of the die 13 with melt 3, the pressure gauge $M_1$ indicates the total pressure in reservoir 2.

After the solidification of the cast body within the die 13, valves C and c are opened; at that the space around the die 13 and the space between cylinder 5 and hood 8 are relieved of pressure, and the nitrogen flows out of the space of the die 13. In the space between the cylinder 5 and the hood 8 there are still acting the sulfur dioxide or argon at a pressure equal to that of the ambient atmosphere. The pressure gauges M and $M_1$ indicate zero readings. Valve $g_1$ is closed and valve g is opened, and at that the differential pressure M is switched to read the pressure in reservoir 2 for the melt 3.

Valves C and c are normally closed. The opening of the outlet pipe conduit behind valve c is disposed higher than the level of the intermediate platen 12. It is therefore not possible for air to enter the space between cylinder 5 and hood 8 during the opening of the die 13. If necessary, valve c can be closed during the opening of the die 13. The layer of heavy protective gas in the space between the feeders and the bottom end of the additional feed tube 18 also avoids the entering of air in the space between cylinder 5, hood 8 and intermediate platen 12.

After the cooling of the cast body down to the temperature at which it can be removed, the upper half of the die 13 is opened and the cast body is removed from the die 13 and the latter is prepared for the next-following casting cycle.

The described embodiment relates also to low-pressure and vacuum casting. In these cases the reservoir 2 for the melt remains constantly under pressure, and above the level of the melt 3 in the reservoir 2 and in the basic feed tube 6 one and the same gas is acting.

The preferred embodiment, according to the invention, does not exclude the possibility for vertical motion of the reservoir 2 for the melt 3 with regard to the pressing of the slide valve 10 against the elastic seal of the flange cover 7 of the basic feed tube 6 and for pulling out the additional feed tube 18 of the enlargement 61 of the basic feed tube 6.

What we claim is:

1. A pressure die casting method which comprises the steps of:

(a) introducing a melt of a molten metal into a reservoir within a pressurizable housing and having a feed tube extending upwardly from said melt and downwardly through an upper surface of said melt;

(b) providing a casting die with a mold cavity having a downwardly extending die tube adapted to communicate with said feed tube;

(c) initially blocking communication between said tubes at least in part by axially separating same and closing the top of said feed tube by sliding a plate across the top of the feed tube and across the bottom of a chamber in which said die tube is disposed;

(d) thereafter pressurizing said housing with a pressurized gas phase and communicating said pressurized gas phase to said feed tube above the melt therein to generate a superatmospheric pressure above the melt in said reservoir and feed tube, said pressure being above a pressure in said die;

(e) then interconnecting said tubes by opening the top of said feed tube and lowering said die tube axially into said feed tube and establishing a pressure differential between said die and said reservoir tending to displace melt from said reservoir through said feed tube and said die tube into said die while displacing the pressurized gas phase of said feed tube ahead of the melt therein into said die, said melt filling said cavity, and said chamber being in gas communication with said housing during the displacement of the melt into said cavity;

(f) subsequently to the filling of said cavity with said melt, equalizing pressure between the upper portion of said feed tube and said housing, thereby permitting melt in said feed tube to recede to said reservoir;

(g) thereafter closing communication between said tubes by withdrawing said die tube from said feed tube and sliding said plate across the top of said feed tube and the bottom of said chamber, and closing gas communication between said chamber and said housing;

(h) removing the cast body from said die; and (i) flushing said cavity in said die with said pressurized gas phase before displacing said melt into said cavity.

2. A pressure die casting apparatus comprising:

a pressurizable housing having a reservoir for a melt of molten metal;

a feed tube having a lower end immersed in said melt and extending upwardly from said housing with an upper end located outside said housing;

a casting die disposed above said housing and formed with a mold cavity and a die tube communicating with said mold cavity and registering with said feed tube, said die tube being surrounded by means forming a downwardly open chamber;

means for relatively displacing said die and said feed tube axially whereby in one position said die tube extends axially into and communicates with said feed tube and in another position said feed tube is spaced from said die tube, said feed tube being formed with a seal at its upper end;

a movable valve plate shiftable all across said upper end of said feed tube transverse to the axis thereof in said other position to engage said seal and block said upper end of said feed tube while closing the bottom of said chamber;

means for pressurizing said housing with a pressure gas phase to drive said melt up said feed tube and into said cavity through said die tube when said tubes communicate with one another; and means including a valve communicating between the interior of said housing and said upper end of said feed tube at a location above the lower end of said die tube in said one position to equalize the pressure therebetween and provide said gas phase above the melt in said feed tube, said feed tube having an enlargement at its upper end receiving said die tube with all around clearance, said die being mounted upon a platen from which said die tube extends, and said valve plate being carried by said platen, and another valve connecting said chamber to said housing.

3. The apparatus defined in claim 9 wherein the means for relatively displacing said die and said feed tube includes a mechanism to said feed tube for raising and lowering same, said reservoir being provided with a recess receiving the lower end of said feed tube.

4. The apparatus defined in claim 2 wherein said platen is provided with a cylinder and said housing is formed with a neck slidable in said cylinder and surrounding said enlargement, said neck and said cylinder defining a clearance, said apparatus further comprising means communicating between the interior of said housing and said clearance and including said valve for maintaining said gas phase in said clearance.

5. The apparatus defined in claim 4, further comprising a pressurizable enclosure receiving said die-form on said platen, said enclosure having a cover displaceable relative to said platen for affording access to said cavity, and means for pressurizing said enclosure and said cavity with a lighter gas than said phase.

6. The apparatus defined in claim 5, further comprising valve means interconnecting said housing and said enclosure for controlling the pressure differential therebetween and a gauge connected across said housing and said enclosure for indicating said pressure differential.

7. The apparatus defined in claim 5, further comprising a pressure gauge communicating with the space around said die tube for displaying the pressure therein.

* * * * *